US005300213A

United States Patent [19]

Bartilucci et al.

[11] Patent Number: 5,300,213

[45] Date of Patent: Apr. 5, 1994

[54] PROCESS FOR MAKING BASESTOCKS FOR AUTOMATIC TRANSMISSION FLUIDS

[75] Inventors: Mark P. Bartilucci, West Chester; John T. Fogarty, Bristol, both of Pa.; Angela S. Galiano-Roth, Mullica Hill, N.J.; Francis X. Kelly, Glen Mills, Pa.

[73] Assignee: Mobil Oil Corporation, Fairfax, Va.

[21] Appl. No.: 983,340

[22] Filed: Nov. 30, 1992

[51] Int. Cl.[5] ..... C10G 1/04; C10G 21/00

[52] U.S. Cl. ..... 208/87; 208/16; 208/18

[58] Field of Search ..... 208/59, 18, 27, 58, 208/60, 97, 99, 141, 87, 96, 311

[56] References Cited

U.S. PATENT DOCUMENTS

| | | | |
|---|---|---|---|
| 3,839,189 | 10/1974 | Mills et al. . | |
| 3,880,747 | 4/1975 | Mills et al. | 208/87 |
| 4,622,129 | 11/1986 | Bayle et al. | 208/87 |
| 4,919,788 | 4/1990 | Chen et al. | 208/59 |

FOREIGN PATENT DOCUMENTS

| | | | |
|---|---|---|---|
| 1240913 | 7/1971 | United Kingdom | 10/31/14 |
| 2059433 | 4/1981 | United Kingdom | 10/67 |

*Primary Examiner*—R. Bruce Breneman
*Assistant Examiner*—Bekir L. Yildirim
*Attorney, Agent, or Firm*—Alexander J. McKillop; Malcolm D. Keen; Jessica M. Sinnott

[57] ABSTRACT

An automatic transmission fluid basestock of mineral oil origin is produced from a neutral distillate fraction, preferably a medium neutral distillate, by severe furfural extraction to a dewaxed oil equivalent VI of about 95, severe hydrocracking, at temperatures ranging from at least about 700° F. and pressures of at least about 1,500 psig, to achieve a minimum product VI of 120. The hydrocracked product is vacuum distilled to recover a lubricant oil product boiling above about 650° F. which has a VI of at least 120 and a viscosity at 100° F. of at least 100 SUS. The viscosity of the 120 VI product can be increased by increasing the distillation cut point without impacting the VI. The lubricant oil, having a wax content below 30 wt. %.

15 Claims, 2 Drawing Sheets

PROCESS FOR MAKING BASESTOCKS FOR AUTOMATIC TRANSMISSION FLUIDS

FIELD OF THE INVENTION

The invention relates to the production of lubricant basestocks, specifically, basestocks suitable for automatic transmission fluids. The basestocks are made by subjecting a neutral distillate to severe solvent extraction and hydrocracking under specific conditions, to achieve a high viscosity base oil with enhanced low temperature performance.

BACKGROUND OF THE INVENTION

An automatic transmission fluid (ATF) must fulfill special requirements because of the conditions of its use. During normal use, automatic transmission fluids can be exposed to extremes of low and high temperatures, i.e. temperatures which can range from about −30° C. to +175° C. Therefore, essential features of an ATF include a low viscosity at a low temperature, a high viscosity index (VI) and a low pour point.

The measurement of viscosity indicates a fluid's resistance to flow which tends to decrease as the temperature increases and increase as the temperature decreases An ATF, under normal operating temperatures (i.e., 80° C. to 120° C.) must have a sufficiently high viscosity to provide adequate lubrication. However, when the temperature increases, it must retain sufficient viscosity for adequate film and wear protection. As temperatures decrease, it must maintain proper fluidity.

Viscosity Index (VI) is an indicator of how fast a fluid decreases in viscosity, or thins, as the temperature increases and the amount of thickening, or increase in viscosity, which occurs as the temperature decreases. VI is determined from the kinematic viscosity of a fluid based on known viscosity-temperature relationships.

However, knowing the VI does not always help predict the lubricant viscosity at temperatures below about −5° C. At these lower temperatures, the viscosity of even very high VI oils can deviate from the expected viscosity as predicted from the known viscosity-temperature relationship. Thus, when an oil is described as possessing a high VI it is not entirely clear that this oil will have the necessary low viscosity at low temperatures required for ATFs.

A special test called the Brookfield viscosity test (ASTM D2981) has been developed to evaluate low temperature viscosity performance, as pointed out in Schodel "Automatic Transmission Fluids (ATFs)-The Improvement of Low Temperature Characteristics", 47 Lubrication Engineering pp 463–467 (June 1991). The Brookfield viscosity test measures the viscosity of fluids over temperatures ranging from −5 to −40° C.

To achieve low pour point and good viscosity properties for ATF basestocks, refiners have considered solvent extraction followed by catalytic dewaxing of neutral distillates to produce 100 SUS oils. However, this has only achieved moderate success as the lubricants can suffer from low viscosity and VI.

Although high severity catalytic dewaxing of slack waxes can meet the very low pour point requirements, this is a costly proposition.

Upgrading crude fractions of low quality, such as high asphaltene, resinous fractions, for lubricant manufacture can be performed by hydrocracking, sometimes referred to as "severe hydrotreating". In this process a fraction from the upper portion of the lubricant boiling range is catalytically reacted with hydrogen under pressure. The process converts the components which are unsuitable for lubricant performance to those which are suitable. A substantial fraction of the polynuclear aromatics is hydrogenated and cracked to form naphthenes and paraffins. Process conditions and choice of catalyst are selected to provide an optimum conversion of the polynuclear aromatic content of the stock since this component degrades the viscosity index and stability of the stock. The paraffins are isomerized to impart good VI characteristics to the final product.

Hydrocracking to produce conventional base stocks from marginal crudes has been carried out as a standalone process in which the feed is directly subjected to the hydrocracker without preliminary solvent extraction. The hydrocracking process has greater feedstock flexibility and gives higher yield and quality compared to solvent refining. The disadvantages, however, include higher capital cost, lower basestock viscosity and lower aromatics content which may require reformulation to aid in additive solubility. Also, although hydrocracking improves product VI, hydrocracked stocks generally have poor seal compatibility, an unacceptably high pour point and must be dewaxed by solvent or catalytic dewaxing.

Processes which combine solvent refining and hydrocracking have been proposed with the goal of retaining the high product yield of standalone hydrocracking while maintaining the viscosity properties and lower processing costs of solvent refining.

U.S. Pat. No. 4,622,129 describes a process for making lubricating oils from nitrogenous distillates and/or deasphalted oils by the solvent extraction and hydroprocessing of a wide variety of crude oils. A more valuable lubricant product, in high yield and of consistant product quality is proposed. The base oils after solvent dewaxing are described as possessing pour points below about −9° C. and VI of about 95. There is no indication of the low temperature viscosity properties necessary for a basestock to be used in automatic transmission fluids and from the VI, the product has not met the VI requirements.

United Kingdom patent No. 1240913 describes a modification in lubricant processing by solvent extraction and catalytic hydrotreating to achieve a high VI product. The described chargestock covers a wide range of petroleum fractions having a VI less than 90 and the proposed solvent extraction and hydrorefining conditions applicable to this range of feeds is equally as broad. There is no description of the low temperature properties of the product. A wax distillate fraction (VI of 70) is subjected to furfural extraction to a VI of 107 and pour point of +105. The raffinate is then mildly hydrorefined at a temperature of 775° F. and pressure of 2,500 psig and solvent dewaxed to produce a lubricant having a VI and pour point ranging from VI 101, 0° F. pour point, to VI 110 and −20° F. pour point, depending upon the space velocity. Although the pour point is good, and a VI of 101 is not considered low, for purposes of ATF performance, better properties would be a significant advance in basestock production for automatic transmission fluids. Also, there is no indication that the lubricant product would meet the low temperature Brookfield viscosity specifications essential for an ATF.

United Kingdom patent application No. 2059433 describes another attempt to improve the VI of a paraffinic raffinate to achieve a base oil suitable for manufacturing a high performance industrial oil. The base oil is made by mild extraction and mild hydrocracking conditions of temperature ranging from 375–450° C. and pressure ranging from 30 to 100 bars (435 to 1,450 psig). The properties of the chargestock are defined in terms of the aromatics content which range from 10 to 35% by weight. The highest reported VI is 114 with pour points ranging from −9 to −24° C. For purposes of achieving an ATF basestock suitable for purposes of an automotive ATF performance, at minimum additive treat levels, it is preferred for the basestock to achieve a still higher VI, while maintaining a low pour point.

Moreover, industrial oils which are referred to in U.K. 2059433 are not expected to meet the same rigorous performance specifications as automotive oils which are exposed to much more severe conditions.

The automatic transmission is a hydrokinetic unit, converting power from the engine into kinetic energy in the torque converter pump. The engagement of clutches and bands has to be rapid and smooth for good driver shift feel characteristics and vehicle performance. It is this mechanism that automatic transmission companies are concerned with for new designs. As well as focusing on automatic transmission design, automobile manufacturers have looked at ATFs for improving driveability. Certain manufacturers have developed specifications which ATFs must meet, i.e., General Motors DEXRON II and Ford MERCON. The concern for better driveability also prompted General Motors to set the lead for more stringent low temperature viscometric requirements for ATFs, i.e. 20,000 cP (DEXRON IIE) vs. 50,000 cP (DEXRON IID) maximum Brookfield viscosity at −40° C.

By contrast, the most common type of power transmission units used in industrial applications (i.e. manufacturing machines, farm, construction and off-highway vehicles and equipment) are hydrostatic drive transmissions. The hydrostatic transmission consists of a pump and motor as opposed to the torque converter, planetary gears, clutches and bands of an automatic transmission. The DEXRON IIE specifications for industrial hydrostatic transmission fluids have no low temperature viscosity performance specifications and allow the VI to range from 105 to 150, as opposed to the Brookfield viscosity maximum of 20,000 cP at −40° C. and VI of 190 which are required for automatic transmission fluids. Thus, although a VI of 114 is reported in U.K. 2059433, because of the unpredictability of the viscosity properties at low temperatures, success in terms of low temperature viscosity properties would not be expected by utilizing a specific feedstock at more severe process conditions.

U. S. Pat. No. 3,880,747 discloses treating a naphthenic distillate stock boiling above 580° F. with an aromatics selective solvent and hydroprocessing to produce a basestock for automatic transmission use. The broad hydroprocessing conditions include temperatures ranging from about 500° F.–800° F. 0.1–8.0 L.H.S.V., pressure of 500 to 3,000 p.s.i, and hydrogen circulation ranging from 0–20,000 SCF/bbl. There is no description of achieving a high VI oil which has good viscosity properties at low temperatures.

A "naphthenic" distillate, as referenced in U.S. Pat. No. 3,880,747, is described in U.S. Pat. No. 3,839,189. The naphthenic distillate is a vacuum distillate fraction which is preferrably wax-free and has a viscosity-gravity constant (VGC) in the range of 0.820 to 0.899 and a viscosity in the range of 150–12,000 SUS at 100° F. The fraction can be obtained by deep furfural extraction to produce a wax-free low VGC fraction.

These disclosures fail to recognize the advantages of using a medium neutral distillate and high pressure hydrocracking conditions in order to obtain good viscosity properties at low temperatures.

SUMMARY OF THE INVENTION

An improved process for making an ATF basestock for high performance automotive purposes having a high VI and a low temperature viscosity from a paraffinic mineral oil has now been discovered.

It is an object of the invention to produce basestocks for automatic transmission fluids of mineral oil origin which have a high VI and very good low temperature viscosity.

It is a feature of the invention to subject a neutral distillate fraction to a combination of solvent extraction and hydrocracking under specific conditions which produce a lubricant meeting the low temperature viscosity and VI properties of a basestock for an automatic transmission fluid.

A further feature of the invention is increasing the distillation cut point to increase the product viscosity without impacting the VI.

An advantage of the invention is reduced dewaxing requirements over slack wax processing, making ATF basestock production more economically feasible.

A further advantage of the process is the low sulfur content of the hydroprocessed products.

The lubricants are produced by solvent extraction and hydrocracking to set the VI, followed by hydrotreating to improve product stability and then dewaxing to set the pour point.

For purposes of this invention hydrocracking and hydrotreating are referred to herein collectively as "hydroprocessing". Additionally, hydrocracking and hydrotreating may be distinguished by the process conditions employed during each step. Typically, these steps are distinguished most consistently in terms of hydrogen consumption. The hydrocracking step consumes about 100 to 1,000 SCF/bbl (standard cubic feet per barrel of feed) while the hydrotreating step consumes less than 0 to 200 SCF/bbl.

The lubricants of the invention have demonstrated utility in ATF formulations, as well as automotive and industrial gear oil formulations.

The invention is directed to a process for the production of a lubricant oil from a petroleum fraction boiling between about 600° F. and about 1,100° F. which contains aromatics, comprising the steps of: contacting the petroleum fraction with a solvent selective for the aromatics to produce an aromatics-reduced raffinate; conveying the aromatics-reduced raffinate to a catalytic hydrocracking zone in the presence of hydrogen and a hydrocracking catalyst; maintaining the hydrocracking zone at conditions of temperature of at least about 650° F. and hydrogen partial pressure of at least about 1,500 p.s.i.g. and hydrotreating to a temperature of about 600° F. and pressure of at least about 1,900; recovering by fractionation of the hydrocracked product a lubricant oil boiling above about 650° F.; and subjecting the lubricant oil to dewaxing, the dewaxed lubricant oil having a VI greater than about 120, a pour point temperature of not more than 20° F. and a kinematic viscosity of at least about 20 cSt. at 40° C. and at least about 4 cSt. at 100° C.

DETAILED DESCRIPTION OF THE INVENTION

Feedstock

Figure 1:
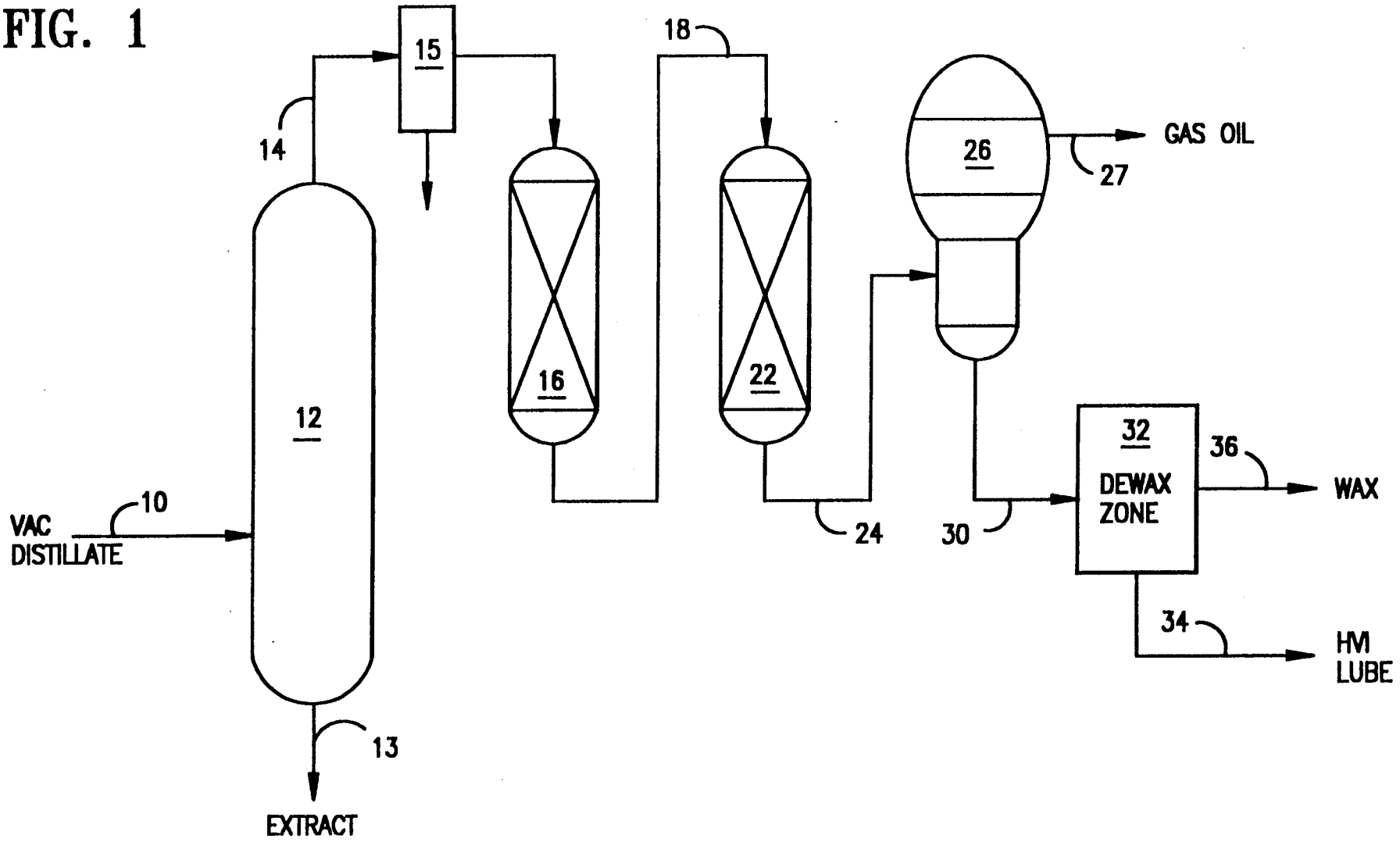
FIG. 1 is a simplified schematic diagram of the lubricant refining process of the invention.

This process is applicable to paraffinic feedstocks boiling in the lubricant boiling range. The feedstocks may typically comprise hydrocarbons having about a 650° F.+ (343° C.) initial boiling point and a final boiling point of about 1100° F. (593° C.), particularly those having a boiling range of about 700° F. (371° C.) to 1050° F. (566° C.), most preferably those fractions boiling in the range of 750° F. (399° C.) to 1000° F. (538° C.). These distillate lubricant stocks are usually referred to as neutrals and are the distillate fractions of the vacuum tower.

Preferably the feed is a petroleum fraction boiling between about 650° F. and about 1100° F. which contains aromatics. This petroleum fraction should have a kinematic viscosity of at least about 7cSt @ 100° C., preferably ranging from about 7 to about 12 cSt @ 100° C., more preferably from about 8 to 10 cSt @ 100° C. The wax content should range from at most about 30 wt. % wax, preferably from 0 to 25 wt. % wax, even more preferably from 0 to 20 wt. % tax.

The medium neutral distillate is the preferred feedstock since this produces a raffinate product with optimum viscosity and VI properties for purposes of the final ATF basestock. The amount of polynuclear aromatics before solvent extraction ranges from about 10 to 20 wt. %, specifically about 10 to 15 wt. %.

Solvent Extraction

Solvent extraction is conducted by contacting the distillate fraction with a selective solvent. Since the feedstock contains aromatics usually ranging from at least about 25 wt. %, specifically from 25 to 80 wt. % and more specifically from 30 wt. % to 60 wt %, the feedstock is initially subjected to an extraction step. Extraction utilizes a solvent which is selective for aromatics, such as furfural, and removes the aromatics which contribute to poor stability and VI.

We found that subjecting a medium neutral feed to a more severe solvent extraction than normally used for a medium neutral feed intended for subsequent hydroprocessing, results in the high VI basestock with good low temperature viscosity.

The solvent extraction is conducted with at least an equal volume percent of the solvent. It is preferred to use about 1.0 to 4.0 volumes, preferably about 1.5 to 3 volumes, of solvent per volume of oil.

The operating conditions for furfural extraction cover a temperature range of about 140° F. (60° C.) to about 280° F. (138° C.), preferably from about 230° F. (110° C.) to 260° F. (127° C.). The yield in terms of volume percent ranges from 30 to 80.

The characteristics of the product of solvent extraction are very important, and consideration of the solvent extraction conditions coupled with the choice of feed is necessary to achieve a product with the desired viscosity and VI, maximum yield of high VI product is achieved by adjusting the extraction severity. The resulting raffinate upon dewaxing should have a VI of at least 90, preferably 95.

The aromatics-reduced raffinate should contain at most about 40 wt. % aromatics, preferably ranging from about 10 to 30 wt. %, even more preferably from 10–20 wt. %.

Hydroprocessing

Hydroprocessing includes the steps of hydrocracking and hydrotreating which are distinguished by their conditions of reaction and product characteristics.

The hydrocracking conditions are important for achieving the established product viscosity, VI, pour point and low temperature viscometrics.

The hydrocracking severity is conducted to convert the solvent refined oil, having a VI of at least about 90 upon dewaxing, to a high VI product, having a VI within the range of about 120 to 130 upon dewaxing, preferably ranging from about 123–126 and a maximum pour point temperature of up to about 20° F., preferably up to about 0° F.

The hydrocracking severity is also conducted to assure a good low temperature viscosity, measured by the Brookfield viscosity test. At −40° C., under General Motors' DEXRON IID specifications, the Brookfield viscosity should be no higher than 50,000 cP., and at −23° C., the Brookfield viscosity should be no higher than 4,000 cP. To meet the more stringent DEXRON IIE specifications, the Brookfield viscosity should range from about 16,000 to 20,000 cP., more preferably, from about 14,000 to 16,000 cP. at −40° F. While at −30° C., the Brookfield viscosity should range from about 1,200 to 1,400 cP., more preferably from about 1,000 cP. to 1,200 cP.

In order for the basestock to have appropriate flow characteristics at the high and low temperatures, the kinematic viscosity is at least about 20 cSt at 40° C., preferably within the range of about 20.0 to 24.0, more preferably about 21.0 to 23.0 cSt at 40° C. and at least about 3 cSt., preferably from about 3.5 to 5.5 cSt., more preferably from about 4.0 to 5.0 cSt at 100° C.

The conditions of hydroprocessing are very important for purposes of achieving the foregoing specifications in the final, formulated, product. The temperature of hydrocracking is in the range of about 600° F. to 720° F. (315° C. to 382° C.), preferably from about 700 to 800° F. (371° C. to 427° C.), these temperatures being the average reactor temperatures.

An even more important condition is the hydrogen partial pressure of reaction which we found should be maintained at least at about 1,500 p.s.i.g., reactor outlet, preferably, in the range of about 1,900 p.s.i.g. to 2,500 p.s.i.g. and most preferably about 2,000 p.s.i.g. The space velocities contemplated range from 0.1 to 5.0 LHSV, preferably 0.2 to 1.0 LHSV, most preferably about 0.50.

The hydrogen gas rate is maintained at a rate between about 2,000 and 9,000 SCF/bbl, preferably between about 5,000 and 8,000 SCF/bbl, and more specifically between about 7,200 and 8,200 SCF/bbl.

Consistent with the objective of increasing VI while providing low pour point properties and low viscosity at low temperatures, the conditions specified promote hydrogenation and isomerization reactions and minimize severe overcracking reactions.

The catalyst used in the hydroprocessing step should be of sufficient acidity to upgrade the severely extracted raffinate and should be able to withstand high reactor temperatures. A suitable conventional lubricant hydrocracking catalyst is made up of a Group VI and/or a Group VIII metal on a suitable substrate. The Group VI metal is usually tungsten or molybdenum and the Group VIII metal usually nickel or cobalt. Combinations such as Ni-W, Ni-Mo or Co-Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient. The catalyst can be treated with a catalyst promotor such as halide of group VIIB of the Periodic Table of the Elements, such as fluoride or chloride to facilitate catalyst activity.

The particle size and the nature of the hydroprocessing catalyst will usually be determined by the type of hydrotreating process which is being carried out. All of the different process schemes are generally well known in the petroleum arts, and the choice of the particular mode of operation is a matter left to the discretion of the operator, although the fixed bed arrangements are preferred for simplicity of operation.

A lubricant of about 123 VI is achieved at acceptable conversion rates. The conversion rate to 650° F.+ fraction will depend upon the chargestock. Thus, with a low viscosity charge stock the conversion can be limited to 25 to 35%. It is advantageous to use the lowest conversion possible while maintaining the high VI target. In any event the medium neutral petroleum fraction to which this invention is directed achieves the appropriate VI characteristics at a conversion of at least about 20 wt. %, preferably about 25 to 45 wt. %, more preferably about 30 to 45 wt %.

The hydrocracked lubricant is subjected to hydrotreating to saturate additional aromatics and to stabilize the product. The quantity of the aromatics at this stage is preferably rather low, ranging from about 0 wt. % to 10 wt %, preferably from about 1 to 5 wt. %.

Conventional hydrotreating catalysts can be employed and the catalyst can be the same as that used for lube hydrocracking. Representative examples of suitable catalysts include a base metal hydrogenation component such as a metal of group VI or VIII of the Periodic Table of the Elements, i.e. nickel, tungsten, cobalt, molybdenum, etc. and combinations thereof such as nickel-tungsten, nickel-molybdenum, or cobalt-molybdenum. The metal hydrogenation component is on an inorganic oxide support of low acidity such as alumina, silica, boria, zirconia, silica-alumina, silica-zirconia, etc. The catalyst can also be treated with a suitable promoter such as fluoride.

To achieve product stability the hydrotreating step is operated at temperatures substantially below the hydrocracking step. Operating conditions in the hydrotreater include temperatures ranging from about 575° F. to 675° F. (301° C. to 357° C.), preferably about 600° F. to 650° F. (315° C. to 343° C.) these temperatures being the average reactor temperatures, pressures in the range of about 1,000 psig to 3,000 psig, preferably from about 1,900 psig to 2,500 psig. The space velocities contemplated range from about 0.1 to 5.0 LHSV, preferably about 0.2 to 1.0 LHSV. The hydrogen gas rate is maintained at a rate which is the same as that maintained during the hydrocracking reaction, i.e. about 2,000 to 8,000 SCF/bbl.

The process can be conducted in more than two reactors with the charge passed from one reactor to the other.

Product Separation

The high viscosity oil should be fractionated to remove the lower boiling components. During the hydrocracking and hydrotreating steps, because it is a relatively high severity operation, lubricant oil products and lower boiling products are formed that require separation. The product effluent of the hydroprocessing operation is separated by distillation, particularly vacuum distillation or flashing.

Separation permits the recovery of a lubricant oil product boiling above about 650° F. from the lower boiling hydrocarbon component. An important consideration is the effect of the distillation cut point on the viscosity and VI properties of the product.

It was discovered that the choice in cut point significantly impacts the viscosity of the product. In general, increasing the cut point increases the product viscosity with minimal impact on the VI. As the cut point varies over a range of 600 to 800° F.+, the product VI of about 123 is relatively constant. Separation of the lubricant oil product is accomplished at a temperature within the range of about 400° F. to about 750° F. under vacuum.

This interrelationship between fractionation and viscosity facilitates modification of the product viscosity to meet performance requirements without impacting product VI. For example, with the medium neutral petroleum fraction of this invention, to obtain a kinematic viscosity of at least about 20 cSt at 40° C., the cut point should be about 650° F.+ and a higher kinematic viscosity of about 25 at 40° C. can be obtained at a cut point of about 720° F.

Lower boiling components which are separated include vacuum gas oil, kerosene and naphtha which can be routed to other refinery processes to produce lighter products such as gasoline and middle distillate fuels. The lighter fractions produced as by-products of the process have a very low sulfur content. Although the naphtha has a low octane, the gas oil has a low cloud point and the kerosene has a low freeze point which are very desirable properties.

Dewaxing

Although the dewaxed and hydroprocessed product contains more than about 10 wt. % wax, typically, about 10 to 30 wt. % wax, more particularly about 15 to 25 wt. % wax, only mild dewaxing is required to achieve an ATF basestock having an acceptable pour point. In the instant invention, the hydroprocessing does not adequately reduce the pour point, making a final dewaxing step necessary.

Dewaxing processes are generally known in the art and any process suitable to achieve the necessary low pour point product may be employed. Dewaxing with methylethylketone or toluene can be used. A combination of methylethylketone and toluene can also be employed to avoid the formation of a third phase. Catalytic dewaxing can be employed, or a combination of methylethyl ketone and/or toluene and catalytic dewaxing can be employed.

In solvent dewaxing, the standard solvent: oil ratio is about 2:1 to 6:1, preferably about 3:1 to 5:1. The filter temperature ranges from about −12° F. to 5° F., depending upon the viscosity of the oil and the desired pour point.

The product is dewaxed in a continuous rotary drum or any other suitable unit.

To catalytically dewax the lubricant, an operation similar to catalytic dewaxing of a hydrocracked slack wax can be employed. However, an advantage of the invention over conventional catalytic dewaxing is a reduction in the process severity which leads to lower processing costs.

An appropriate catalytic dewaxing process is generally described in U.S. Pat. Nos. 4,437,975 and 4,229,282 which are incorporated herein by reference in their entireties.

Appropriate catalytic dewaxing conditions include a $H_2$ partial pressure of about 400 psig, $H_2$ circulation rate of 2500 SCF/bbl, space velocity of 0.5 to 2 LHSV, operating temperatures ranging from 525 to 750° F., and pressures from 400 to 600 psig.

A simplified schematic flow diagram of a specific embodiment of the process of the invention is illustrated in FIG. 1.

In FIG. 1, a vacuum distillate fraction is introduced to the process via line 10, communicating with solvent extraction zone 12. The extract is withdrawn via line 13 while the raffinate is passed via line 14 to a solvent recovery zone to separate the solvent which is recycled and then the raffinate is passed to the hydrocracking zone 16. In hydrocracking zone 16 the raffinate is subjected to severe hydrocracking conditions in accordance with the invention over a hydrocracking catalyst, preferably a NiW catalyst on an alumina support. The hydrocracked product is thereafter transferred to hydrotreating zone 22 to stabilize the product. The hydrotreating zone may utilize the same catalyst. The hydroprocessed lubricant is then conveyed via line 24 to vacuum distillation tower or flash drum 26 which separates a lubricant fraction from a lower boiling gas oil withdrawn via line 27. The lubricant fraction withdrawn via line 30 is conveyed to dewaxing zone 32 from which the high viscosity index lubricant product is withdrawn via line 34 and a wax is withdrawn via line 36. The wax by-product can be subjected to catalytic dewaxing to produce an extra high viscosity index lubricant oil.

Figure 2:
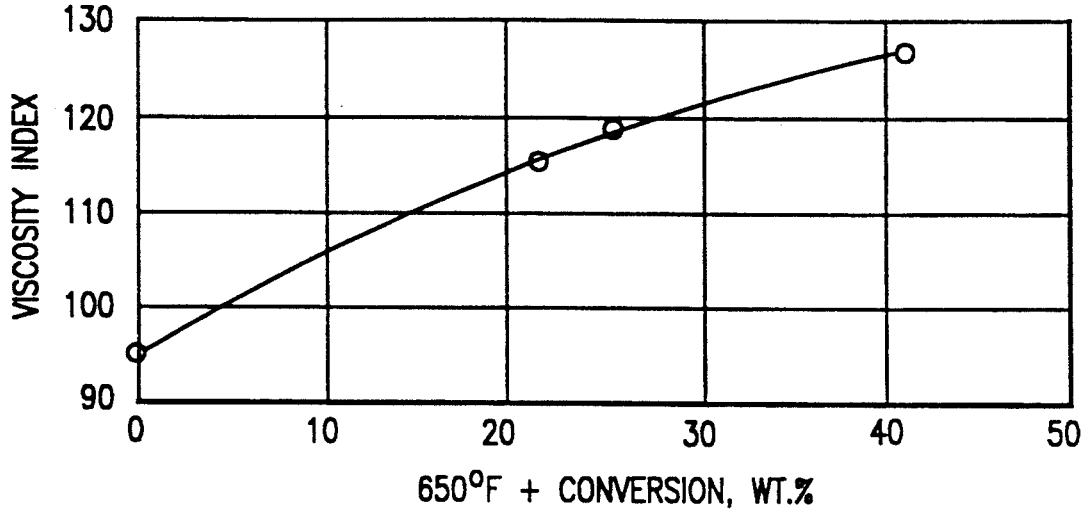
FIG. 2 is a plot of wt. % conversion of the 650° F.+ fraction to a lower boiling point vs. VI.
Figure 3:
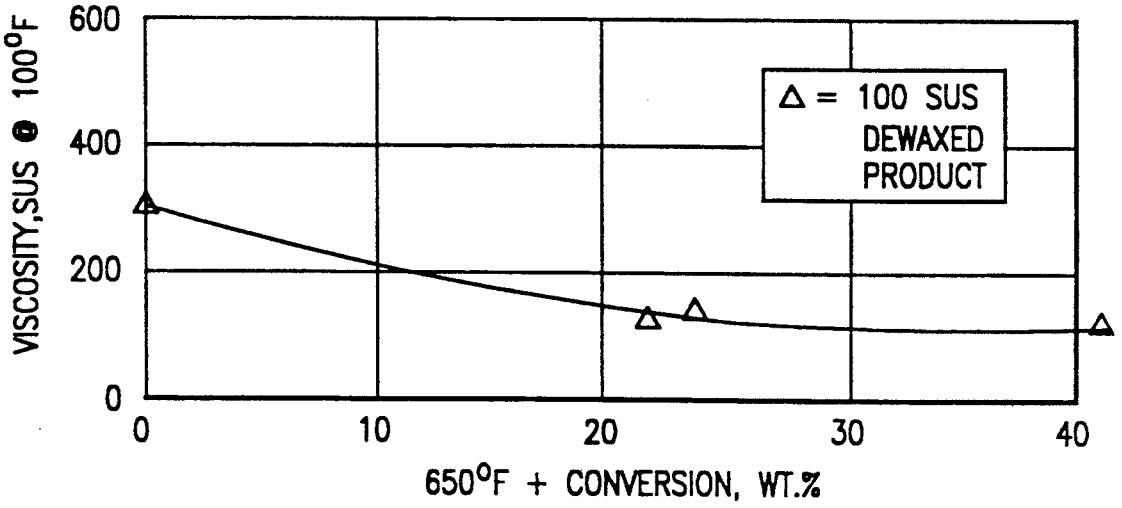
FIG. 3 is a plot of wt. % conversion of the 650° F.+ fraction to a lower boiling point vs. the viscosity @100° F. of a 100 SUS oil.

FIG. 2 shows the general effect of conversion on VI. To achieve a product VI of 123, the process should be run to effectuate at least 30 wt. % conversion to a 650° F.+ fraction. FIG. 3 shows the general effect of conversion on viscosity: for purposes of meeting a viscosity of 100 SUS, conversion should be between 20 and 30.

EXAMPLE 1

A medium neutral distillate fraction was subjected to furfural extraction. The properties of the distillate fraction are set forth below in Table 1.

TABLE 1

| Properties | Medium Neutral Distillate |
|---|---|
| KV @ 100° C., cSt | 9.4 |
| Specific Gravity, °API | 26 |
| Boiling Range, wt. % | |
| 5% | 790 |
| 50% | 890 |

TABLE 1-continued

| Properties | Medium Neutral Distillate |
|---|---|
| 95% | 970 |
| Paraffins, wt % | 22 |
| Naphthenes, wt. % | 35 |
| Aromatics, wt. % | 33 |

The furfural extraction process conditions are set forth in Table 2.

TABLE 2

| Furfural Extraction of Medium Neutral Distillate | |
|---|---|
| Operating Conditions | |
| Furfural Dosage, vol. % | 200 |
| Top Temperature, °F. | 260 |
| Bottom Temperature, °F. | 230 |
| Raffinate Yield, vol. % | 59 |

The properties of a raffinate of this example are presented in TABLE 3.

TABLE 3

| Raffinate Properties | |
|---|---|
| API Gravity | 31 |
| KV @ 100° C., cSt | 6.811 |
| KV @ 300° F., cSt | 2.885 |
| Viscosity @ 100° F., SUS | 243 |
| Hydrogen, wt. % | 14.4 |
| Nitrogen, ppm | 60 |
| Sulfur, wt. % | 0.20 |
| Sim. Dist., wt. % | °F. |
| IBP | 700 |
| 5 | 760 |
| 10 | 784 |
| 50 | 864 |
| 90 | 926 |
| 95 | 942 |
| FBP | 1011 |
| Paraffins, wt. % | 31 |
| Naphthenes, wt. % | 51 |
| Aromatics, wt. % | 18 |

EXAMPLE 2

The raffinate of example 1 was hydroprocessed over a standard hydroprocessing NiW catalyst on an alumina support.

The hydroprocessing was carried out under the conditions described in Table 4.

TABLE 4

| Hydroprocessed 100 SUS Raffinate | |
|---|---|
| OPERATING DATA | Example 1 |
| HDC LHSV, $hr^{-1}$ | 0.50 |
| HDC, Avg. Temp, °F. | 706 |
| HDT Temp, °F. | 625 |
| $H_2$ Feed, SCF/BBL | 8000 |
| $H_2$ Exit Pressure, psig | 1980 |
| LIQUID YIELDS, wt. % | |
| $C_6$-380° F. | 11.8 |
| 380-500° F. | 12.3 |
| 500-650° F. | 16.3 |
| 650° F.+ | 57.7 |

The total liquid product was fractionated to obtain two cuts at increasing temperatures. The properties of the lubricant fraction at each cut point are presented in Table 5.

TABLE 5

| Properties of Light Neutral 100 SUS Lubricant of Example 1 | | | |
|---|---|---|---|
| | Total Liquid Product Cut Point | | |
| | 650° F.+ | 720° F.+ | Target |
| Viscosity @ 100° F., SUS | 110 | 124 | 105–115 |
| KV @ 40° C., cSt | 21.06 | 23.95 | |
| KV @ 100° C., cST | 4.402 | 4.801 | |
| VI @ 0° F. Pour | 123 | 124 | |
| Boiling Range | Dist. Yields Wt. % | | |
| IBP-380° F. | 9 | | |
| 380–500° F. | 14 | | |
| 500–650° F. | 17 | | |
| 650° F.+ | 60 | | |

Figure 4:
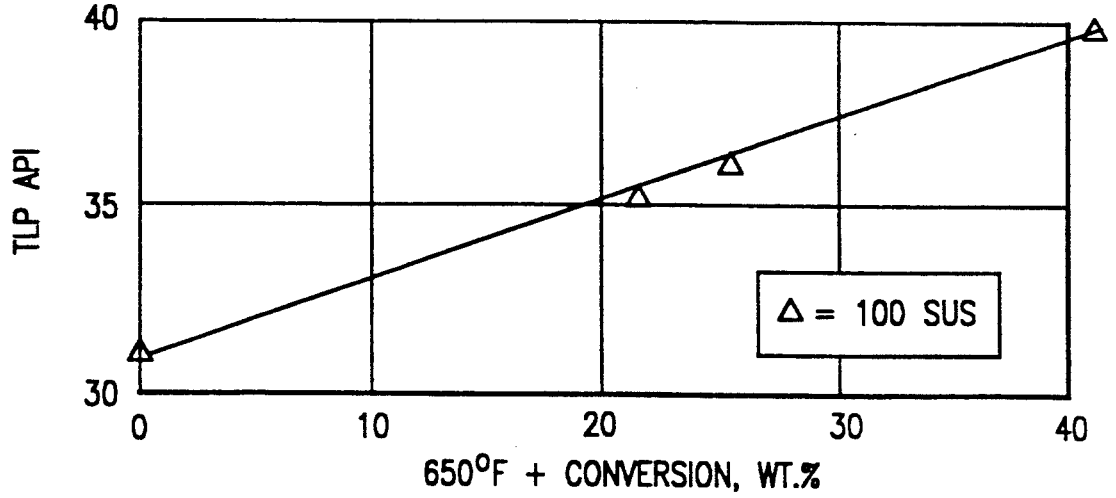
FIG. 4 is a plot of wt. % conversion of the 650° F.+ fraction to a lower boiling point vs. total liquid product (TLP) API gravity of a 100 SUS basestock.

FIG. 2 is a plot of VI v. wt. % conversion and it shows how the VI of the product of this example increased with increasing conversion. FIG. 3 is a plot of viscosity, SUS @ 100° F. v. wt. % conversion and it shows how the viscosity of the product of this example decreased with increasing conversion. FIG. 4 is a plot of total liquid product (TLP) API Gravity v. wt. % conversion and it shows how the API gravity of the product of this example increased with increasing conversion. From FIGS. 2, 3 and 4, it is clear that optimum lubricant properties were achieved when the conditions of hydroprocessing the medium neutral raffinate obtain between at least 40 and 45 wt. % conversion.

EXAMPLE 3

The lubricant product (650° F.+ fraction) of Example 2 was subjected to mild solvent dewaxing with a mixture of methylethylketone (MEK) and toluene.

The following Table 6 presents the condition of solvent dewaxing.

TABLE 6

| Solvent Dewaxing Process Conditions | |
|---|---|
| Solvent Composition (MEK/Toluene) | 50/50 |
| Solvent:Oil ratio | 3:1 |
| Wash (Solvent:Oil) | 2:1 |
| Slurry Temperatures, °F. In Filter | −12 |
| Wash Solvent Temperature, °F. | −12 |

The solvent dewaxed lubricant had the properties set forth in Table 7.

TABLE 7

| Dewaxed Light Neutral 100 SUS Lubricant | |
|---|---|
| Properties | Basestock |
| Viscosity @ 100° F., SUS | 115 |
| KV @ 40° C., cSt | 21.97 |
| KV @ 100° C., cST | 4.552 |
| VI | 123 |
| Pour Point, °F. | 0 |
| Sim. Dist. vol. % | °F. |
| 5 | 696 |
| 50 | 810 |
| 95 | 902 |
| Paraffins, wt. % | 49 |
| Naphthenes, wt. % | 49 |
| Aromatics, wt. % | 2 |

EXAMPLE 4

The following Table 8 presents a comparison of the performance of the basestock of Example 3 blended with an ATF additive package formulated to meet the DEXRON IID specification (designated Product 1) and a solvent extracted and solvent dewaxed basestock blended with the same additive package (designated Product A). The additive package included a defoamant, dye, antiwear agent, antioxidant, borated ashless dispersant, viscosity index improver and friction modifier.

TABLE 8

| DEXRON IID ATF EVALUATION | | | |
|---|---|---|---|
| Properties | Product 1 | Product A | DEXRON IID Specifications |
| VI of Basestock | 123 | 96 | N/A |
| KV @ 100° C., cSt | 7.73 | 7.44 | 6.8–8.0 |
| KV @ 40° C., cSt | 37.6 | 38.1 | 35.6 |
| VI | 182 | 164 | 157 |
| Brookfield Viscosity @ −40° C., cP | 19,160 | 33,100 | 50,000 (max) |
| Brookfield Viscosity @ −23° C., cP | 1,770 | 2,230 | 4,000 (max) |

Comparing the results reported in Table 8, it is apparent that the basestock of Example 3 (Product 1) satisfactorily met the DEXRON IID specifications. The ATF made from the basestock of Example 3 had excellent low temperature viscosity properties while the ATF made from a solvent extracted and solvent dewaxed base fluid (fully solvent refined) had relatively poor low temperature viscosity properties.

The following Table 9 presents a comparison between the properties of the basestock of Example 3 formulated into an ATF (designated Product 2) and a 100 SUS basestock made by furfural extraction and mild hydrocracking which was formulated into an ATF (designated Product B). The products were made by blending the basestock with an additive package designed to meet DEXRON IIE specifications.

TABLE 9

| DEXRON IIE ATF Evaluation | | |
|---|---|---|
| Properties | Product 2 | Product B |
| VI of basestock | 123 | 96 |
| Pour Point of basestock | 0 | 5 |
| Viscosity @ 100° C., cSt | 8.40 | 8.52 |
| Brookfield viscosity @ −40° F., cP | 15,760 | 32,000 |

It is apparent from Table 9 that Product 2 had a better low temperature viscosity than Product B.

The following Table 10, for comparative purposes, presents the properties of a fully formulated ATF made from a solvent extracted and solvent dewaxed basestock (designated Product C) and a 130 SUS high viscosity base oil from wax isomerization (designated Product D). The ATF additive package was designed to meet the DEXRON IID specifications and was slightly different from the ATF additive package used in Table 8. This example demonstrates the unpredicatability of low temperature viscosity properties: a high VI basestock exhibited worse low temperature viscosity properties than a lower VI basestock.

TABLE 10

| Properties | Product C | Product D |
|---|---|---|
| VI of basestock | 96 | 142 |
| Viscosity @ 100° C., cSt | 7.48 | 7.90 |
| Viscosity @ 40° C., cSt | 38.9 | 36.7 |
| VI | 163 | 195 |
| Brookfield viscosity | 35,300 | 324,000 |

TABLE 10-continued

| Properties | Product C | Product D |
|---|---|---|
| @ −40° C., cP | | |
| Brookfield viscosity @ −23° C., cP | 2,680 | 1,710 |

It is thus apparent that, in contrast to earlier approaches which utilized higher boiling range heavier distillate fractions, i.e., heavy neutral distillates, and resids, which attempted to saturate and eliminate aromatics, the present invention advantageously using a lighter, lower boiling range feed and maximum pressure conditions, higher than those used during conventional hydrocracking, and providing conversions limited to less than about 50% boiling below 650° F., achieves high VI products with low viscosity properties at low temperatures.

We claim:

1. A process for the production of a lubricant oil from a neutral distillate petroleum fraction boiling between about 650° F. and about 1,100° F., comprising the steps of:

contacting the petroleum fraction with a solvent selective for the aromatics under extraction conditions of about 1.5 to 3 volumes of solvent per volume of fraction and a temperature of about 230° F. to about 260° F. to produce an aromatics reduced raffinate conveying the aromatics-reduced raffinate to a catalytic hydrocracking zone in the presence of hydrogen and a hydrocracking catalyst;

maintaining the hydrocracking zone at conditions of temperature of at least about 650° F., reactor pressure of at least about 1,500 p.s.i.g. and hydrogen circulation rate of at least about 2,000 SCFB to produce a hydrocracked product;

recovering, by fractionation of the hydrocracked product, a lubricant oil boiling above about 650° F.; and subjecting the lubricant oil to dewaxing under dewaxing conditions sufficient to achieve a maximum pour point temperature of about 20° F. and a kinematic viscosity of at least about 20 cSt at 40° C. and at least about 4 cSt, at 100° C.

2. The process as claimed in claim 1 in which the aromatics reduced raffinate contains at least about 5 wt. % aromatics.

3. The process as claimed in claim 1 in which the hydrogen circulation rate ranges from about 3,000 to about 9,000 SCFB.

4. The process as claimed in claim 1 in which the lubricant oil has a VI of at least about 123 and a maximum pour point temperature of about 15° F.

5. The process as claimed in claim 4 in which the hydrocracked product recovered by fractionation boils above about 650° F. and has a VI of at least 123 and a maximum pour point temperature of about 0° F.

6. The process as claimed in claim 1 in which the hydrocracking catalyst comprises a non-zeolite and as the active component one or more of a material selected from the group consisting essentially of a group VI and group VIII metal.

7. The process as claimed in claim 6 in which the hydrocracking catalyst comprises, as the active component one or more of a material selected from the group consisting essentially of tungsten, molybdenum, nickel and cobalt.

8. A process for the production of a lubricant oil from a neutral distillate petroleum fraction having a kinematic viscosity of about 7–12 cSt @ 100° C. boiling between about 775° F. and about 900° F., comprising the steps of:

contacting the petroleum fraction with a solvent selective for the aromatics to produce an aromatics-reduced raffinate under extraction conditions of about 1.5 to 3 volumes of solvent per volume of fraction and a temperature of about 230° F. to about 260° F. to achieve a yield in terms of volume percent ranging from 30 to 80;

conveying the aromatics-reduced raffinate to a catalytic hydrocracking zone in the presence of hydrogen and a hydrocracking catalyst;

maintaining the hydrocracking zone at conditions of temperature of at least about 650° F., reactor pressure of at least about 1,500 p.s.i.g. and hydrogen circulation rate of at least 3,000 SCF/B to produce a hydrocracked product;

recovering, by fractionation of the hydrocracked product, a lubricant oil boiling above about 650° F.; and subjecting the lubricant oil to dewaxing under dewaxing conditions sufficient to achieve a dewaxed lubricant oil having a VI greater than about 120, a maximum pour point temperature of about 5° F. and a kinematic viscosity of at least about 20 cSt at 40° C. and at least about 4 cSt at 100° C.

9. The process as claimed in claim 8 in which the hydrogen circulation rate ranges from about 3,000 to about 9,000 SCFB.

10. The process as claimed in claim 8 in which the viscosity of the petroleum fraction is at least about 8 to 10 cSt @100° C.

11. The process as claimed in claim 8 in which the wax content of the petroleum fraction is at most about 25 wt. %.

12. The process as claimed in claim 11 in which the hydrocracked product recovered by fractionation boils above about 650° F.

13. The process as claimed in claim 9 in which the lubricant oil has a VI of at least about 123, a maximum pour point temperature of about 0° F. and a kinematic viscosity of at least about 23 cSt. at 40° C.

14. The process as claimed in claim 8 in which the hydrocracking catalyst comprises a non-zeolite and as the active component one or more of a material selected from the group consisting essentially of a group VI and group VIII metal.

15. The process as claimed in claim 14 in which the hydrocracking catalyst comprises, as the active component one or more of a material selected from the group consisting essentially of tungsten, molybdenum, nickel and cobalt.

* * * * *